US006370693B1

(12) United States Patent
Riccio

(10) Patent No.: US 6,370,693 B1
(45) Date of Patent: Apr. 16, 2002

(54) TENNIS GLOVE

(76) Inventor: Steve D. Riccio, 27565 S. View Dr., Bonita Springs, FL (US) 34135-3539

( * ) Notice: Subject to any disclaimer, the term of this patent is extended or adjusted under 35 U.S.C. 154(b) by 0 days.

(21) Appl. No.: 09/670,184

(22) Filed: Sep. 26, 2000

(51) Int. Cl.[7] ..... A41D 19/00
(52) U.S. Cl. ..... 2/160; 2/161.1
(58) Field of Search ..... 2/161.1, 161.2, 2/161.3, 161.4, 161.5, 161.6, 162, 163, 167, 170, 16.2

(56) References Cited

U.S. PATENT DOCUMENTS

| | | | | | |
|---|---|---|---|---|---|
| 2,538,837 | A | * | 1/1951 | Johnston | 2/159 |
| 3,597,765 | A | | 8/1971 | Stanton | 2/159 |
| 4,042,977 | A | | 8/1977 | Antonious | 2/161 A |
| 4,453,275 | A | | 6/1984 | Kamada | 2/161 A |
| 4,514,861 | A | | 5/1985 | Kamada | 2/161 A |
| 4,525,877 | A | * | 7/1985 | Chong | 2/161 |
| 4,751,750 | A | | 6/1988 | Tepley | 2/161 R |
| 4,850,053 | A | | 7/1989 | Tepley et al. | 2/161 R |
| 4,860,385 | A | * | 8/1989 | Zidele | 2/163 |
| 4,908,879 | A | | 3/1990 | Roderman | 2/161 A |
| 5,117,509 | A | * | 6/1992 | Bowers | 2/161 |
| 5,140,709 | A | | 8/1992 | Cohn et al. | 2/163 |
| 5,195,188 | A | * | 3/1993 | Bourdeau et al. | 2/161 |
| 5,390,372 | A | | 2/1995 | Hashimoto et al. | 2/161.2 |
| 5,537,692 | A | | 7/1996 | Dorr | 2/161.1 |
| 5,706,521 | A | * | 1/1998 | Haney | 2/160 |
| 5,708,979 | A | * | 1/1998 | Redwood et al. | 2/161.1 |
| 5,802,615 | A | | 9/1998 | Wenk | 2/161.2 |
| 5,867,830 | A | * | 2/1999 | Chen | 2/161.1 |
| 5,893,172 | A | | 4/1999 | Haynes et al. | 2/161.2 |
| 6,044,494 | A | * | 4/2000 | Kang | 2/167 |
| 6,065,155 | A | | 5/2000 | Sandusky | 2/161.1 |

* cited by examiner

*Primary Examiner*—John J. Calvert
*Assistant Examiner*—Katherine Moran
(74) *Attorney, Agent, or Firm*—Peter Loffler

(57) ABSTRACT

A glove to be worn on the hand of a tennis player has a lower glove portion, which is seamless and made from leather or similar material, engages a portion of the wrist, the palm, the sides of the hand, a majority of each finger and a majority of the thumb, while an upper glove portion is secured to the lower glove portion and engages the remainder of the wrist, the back of the hand, a minority of each finger and a minority of the thumb. An extension is attached to the bottom of the glove and has a moisture absorbing material secured thereto.

23 Claims, 3 Drawing Sheets

TENNIS GLOVE

BACKGROUND OF THE INVENTION

1. Field of the Invention

The present invention relates to a sports glove namely for the sport of tennis.

2. Background of the Prior Art

Many athletes utilize gloves during the sporting event. Some sports gloves serve an integral function relative to the sport. A baseball fielder's glove, boxing gloves, and a hockey goalie's catching gloves are examples of gloves that serve as tools for the athlete. Other gloves serve mainly to protect an athlete's hand from injury. A hockey player's gloves, a soccer goalie's gloves, and a football player's gloves are examples of hand protecting gloves. Still other gloves are used by athletes in order to afford a better grip on another sporting implement. A baseball batter's gloves and a golfer's glove are examples of grip improvement gloves.

One sport that has escaped the glove maker's attention is tennis. A tennis player must keep a solid grip on the racquet both during and between shots. As the player will move the racquet within his hand and between hands and will subject the racquet to high impacts with the ball several times during the play of a point, a glove must address such movement and impact. As tennis is a high energy sport, most players will sweat heavily during play and a glove must also address this issue. As tennis is a "country club" sport, aesthetic appeal of a tennis glove is also desirable.

SUMMARY OF THE INVENTION

The tennis glove of the present invention addresses the aforementioned needs in the art. The tennis glove offers a tennis player a good clean comfortable grip of the racquet even with repeated movement within the player's hand and between hands as well as during impact with the ball both during a serve and during point play. The tennis glove gives the player's hand ventilation as well as helps control hand and wrist sweat. The tennis glove offers aesthetic enhancing properties that make the glove look fashionable.

The tennis glove of the present invention is comprised of a first glove body portion having a lower wrist portion, a palm portion having a pair of side portions, a plurality of lower finger stall portions, and a lower thumb stall portion. A second glove body portion has an upper wrist portion secured to the lower wrist portion, a back portion secured to each of the pair of side portions of the palm portion, a plurality of upper finger stall portions, each secured to a respective one of the plurality of lower finger stall portions, and an upper thumb stall portion secured to the lower thumb stall portion. The upper glove portion is smaller relative to the lower glove portion such that the back portion is smaller than the palm portion, each of the plurality of upper finger stall portions is smaller than the respective lower finger stall portion to which the upper finger stall portion is attached, and the upper thumb stall portion is smaller than the lower thumb stall portion. The lower glove portion is secured to the upper glove portion along a seam. Along the outer edge of the index finger the bottom material extends higher along the outside edge toward the top of the finger adding extra durability and comfort due to no seam along the edge of the finger. The lower glove portion is seamless and is made from leather or other similar high grip material. The upper glove portion is made from an appropriate mesh material. An extension is attached to the lower wrist portion and the upper wrist portion, while a moisture absorbing material is attached to an inner surface of the extension. A flap is secured to the lower glove portion and is removably securable to the upper glove portion.

BRIEF DESCRIPTION OF THE DRAWINGS

Similar reference numerals refer to similar parts throughout the several views of the drawings.

DESCRIPTION OF THE PREFERRED EMBODIMENT

Figure 1:
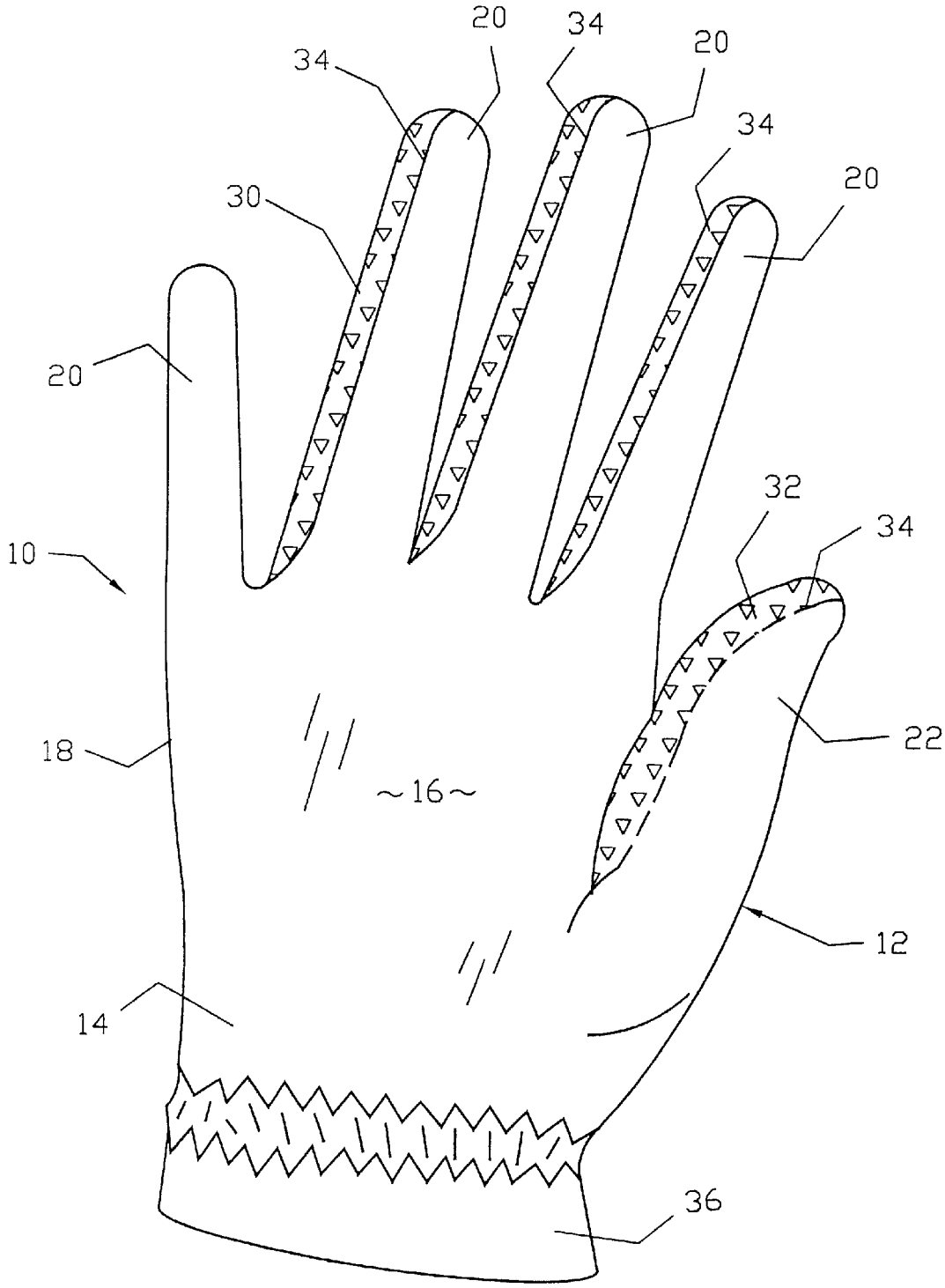
FIG. 1 is a front elevation of the tennis glove of the present invention.
Figure 2:
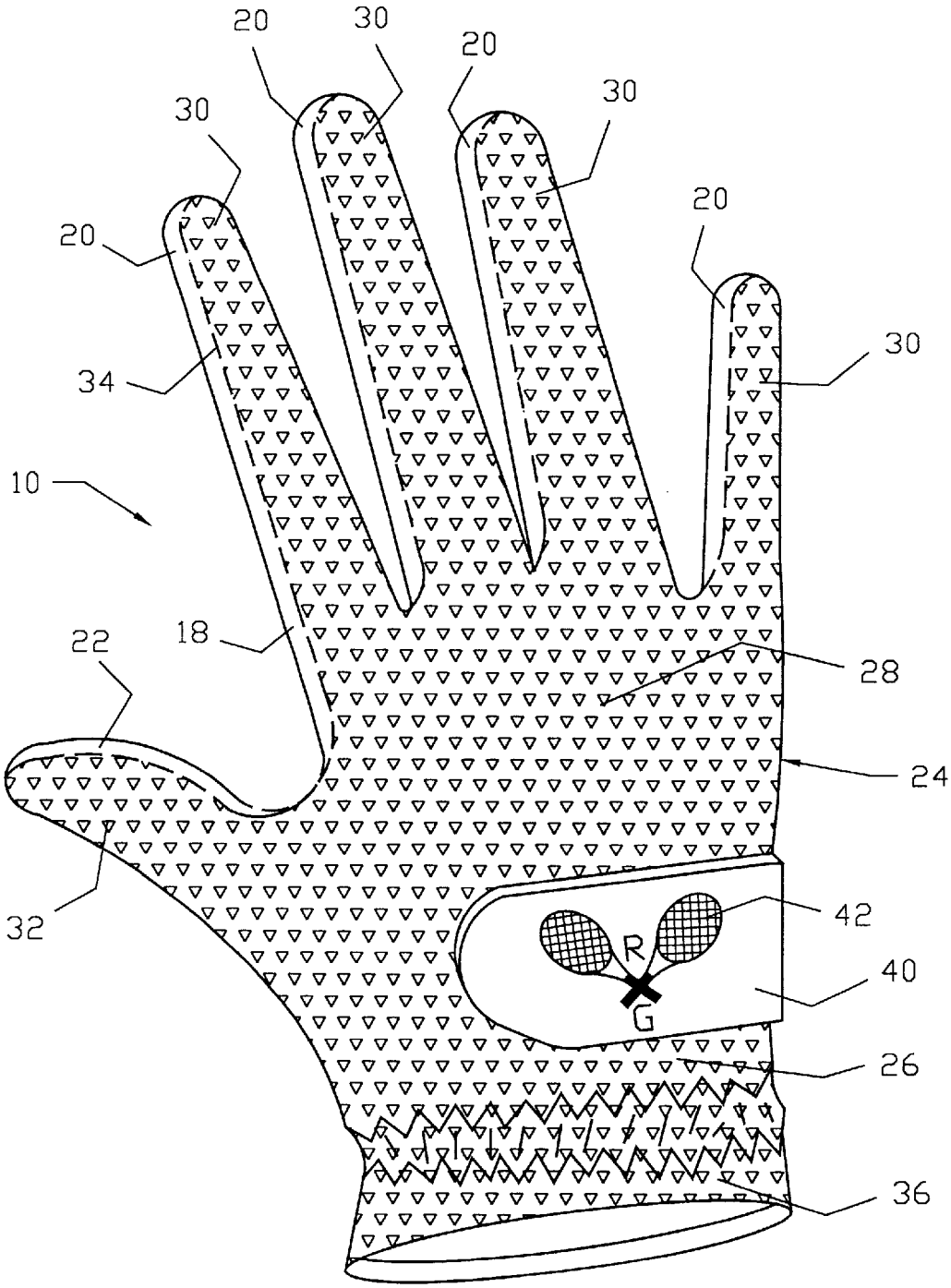
FIG. 2 is a rear elevation of the tennis glove of the present invention.
Figure 3:
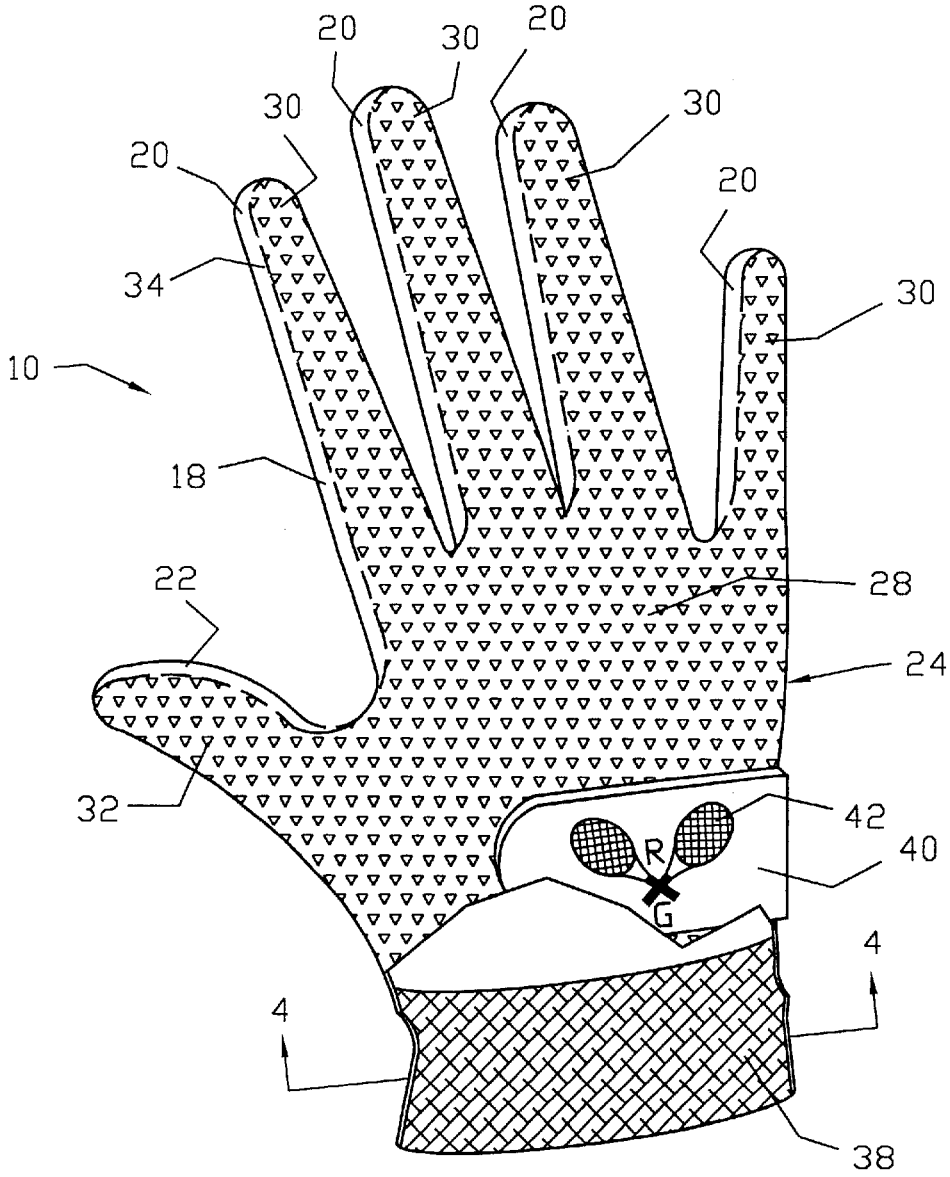
FIG. 3 is a rear elevation of the tennis glove with a section of the upper glove portion peeled away.
Figure 4:
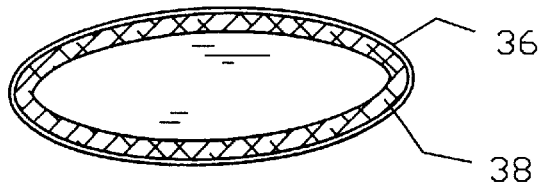
FIG. 4 is a sectioned view of the tennis glove taken along line 4—4 in FIG. 2.

Referring now to the drawings, it is seen that the glove of the present invention, generally denoted by reference numeral 10, is comprised of a lower glove body portion 12 that has a lower wrist portion 14, a palm portion 16 having a pair of side portions 18, a plurality of lower finger stall portions 20, and a lower thumb stall portion 22. An upper glove body portion 24 has an upper wrist portion 26 secured to the lower wrist portion 14, a back portion 28 secured to each of the pair of side portions 18 of the palm portion 16, a plurality of upper finger stall portions 30, each secured to a respective one of the plurality of lower finger stall portions 20, and an upper thumb stall portion 32 secured to the lower thumb stall portion 22. The upper glove portion 24 is smaller relative to the lower glove portion 12 such that the back portion 28 is smaller than the palm portion 16, each of the plurality of upper finger stall portions 30 is smaller than the respective lower finger stall portion 20 to which the upper finger stall portion 30 is secured, the upper thumb stall portion 32 is smaller than the lower thumb stall portion 22, and the upper wrist portion 26 is smaller than the lower wrist portion 14, with the term smaller being defined as the portion that is smaller covers less area relative to the portion to which the smaller portion is being compared. Accordingly, the lower thumb stall portion 22 encompasses a greater portion of the user's thumb than does the upper thumb stall portion 32, each of the lower finger stall portions 20 encompasses a greater portion of the respective finger of the user than does the respective upper finger stall portion 30 to which the lower finger stall portion 20 is secured, and the lower wrist portion 14 encompasses a greater portion of the wrist of the user than does the upper wrist portion 26.

The lower glove portion 12 is secured to the upper glove portion 24 along a seam 34. The lower glove portion 12 is seamless and is made from leather or other similar material in order to afford the user a solid and secure grip of the tennis racquet. The upper glove portion 24 is made from an appropriate mesh material in order to allow the user's hands to breathe. An extension 36 is attached to the lower wrist portion 14 and the upper wrist portion 26 and extends downwardly therefrom, while a moisture absorbing material 38, such as terry cloth, is attached to an inner surface of the extension 36 in order to absorb sweat generated by the user's hand and wrist. The extension 36 is appropriately selvaged. A flap 40 is secured to the lower glove portion 12 and removably securable to the upper glove portion 24. The flap 40 acts as a closure in order for the glove 10 to be secured onto the user's hand. Cooperating hook and loop material (not illustrated) is located on the flap 40 and on the upper glove 24 portion in order to provide for removable securement of the flap 40 to the upper glove portion 24. An insignia 42 may be placed on the outer surface of the flap 40 in order to enhance the aesthetic appeal of the glove 10.

In order to use the tennis glove 10 of the present invention, the user places his hand into the glove 10 and uses the flap 40 to secure the glove onto the hand. Thereafter, the user plays tennis. The seamless nature of the lower glove portion 12 assures the user of a solid grip on the racquet despite repeated racquet movement within the user's hand and between hands as well as during racquet impact with the ball. The mesh nature of the upper glove portion 24 allows the user's hand to breathe during use and the moisture absorbent material 38 within the extension 36 captures any sweat generated by the user's hand or wrist.

While the invention has been particularly shown and described with reference to an embodiment thereof, it will be appreciated by those skilled in the art that various changes in form and detail may be made without departing from the spirit and scope of the invention.

I claim:

1. A glove comprising:

a lower glove body portion having a lower wrist portion, a palm portion having a pair of side portions, a plurality of lower finger stall portions, and a lower thumb stall portion;

a lower glove body portion having an upper wrist portion secured to the lower wrist portion, a back portion secured to the pair of side portions of the palm portion, a plurality of upper finger stall portions, each secured to a respective one of the plurality of lower finger stall portions, and an upper thumb stall portion secured to the lower thumb stall portion; and an extension attached to the lower wrist portion and the upper wrist portion.

2. The glove as in claim 1 wherein the back portion is smaller than the palm portion.

3. The glove as in claim 1 wherein each of the plurality of upper finger stall portions is smaller than the respective lower finger stall portion to which the upper finger stall portion is secured.

4. The glove as in claim 1 wherein the upper thumb stall portion is smaller than the lower thumb stall portion.

5. The glove as in claim 1 wherein the upper wrist portion is smaller than the lower wrist portion.

6. The glove as in claim 1 wherein the lower glove portion is seamless.

7. The glove as in claim 1 wherein the lower glove portion is secured to the upper glove portion along a seam.

8. The glove as in claim 1 wherein the lower glove portion is made from leather.

9. The glove as in claim 8 wherein the upper glove portion is made from a mesh material.

10. The glove as in claim 1 wherein the upper glove portion is made from a mesh material.

11. The glove as in claim 1 further comprising a moisture absorbing material attached to an inner surface of the extension.

12. The glove as in claim 1 further comprising a flap secured to the lower glove portion and removably securable to the upper glove portion.

13. A glove for receiving a user's hand, the hand having a wrist, a palm, a pair of sides, a plurality of fingers, and a thumb, the glove comprising:

a lower glove body portion having a lower wrist portion, a palm portion having a pair of side portions, a plurality of lower finger stall portions, and a lower thumb stall portion;

an upper glove body portion having an upper wrist portion secured to the lower wrist portion, a back portion secured to the pair of side portions of the palm portion, a plurality of upper finger stall portions, each secured to a respective one of the plurality of lower finger stall portions, and an upper thumb stall portion secured to the lower thumb stall portion;

an extension attached to the lower wrist portion and the upper wrist portion; and wherein the lower wrist portion and the upper wrist portion are adapted to receive the wrist, the palm portion is adapted to engage the palm, the side portions are adapted to engage the pair of sides, the plurality of lower finger stall portions and the secured respective upper finger stall portions are adapted to receive the plurality of fingers, and the lower thumb stall portion and the upper thumb stall portion are adapted to receive the thumb.

14. The glove as in claim 13 wherein the lower thumb stall portion encompasses a greater portion of the thumb than the upper thumb stall portion.

15. The glove as in claim 13 wherein each of the lower finger stall portions encompasses a greater portion of the respective finger than the respective upper finger stall portion to which the lower finger stall portion is secured.

16. The glove as in claim 13 wherein the lower wrist portion encompasses a greater portion of the wrist than the upper wrist portion.

17. The glove as in claim 13 wherein the lower glove portion is seamless.

18. The glove as in claim 13 wherein the lower glove portion is secured to the upper glove portion along a seam.

19. The glove as in claim 13 wherein the lower glove portion is made from leather.

20. The glove as in claim 19 wherein the upper glove portion is made from a mesh material.

21. The glove as in claim 13 wherein the upper glove portion is made from a mesh material.

22. The glove as in claim 13 further comprising a moisture absorbing material attached to an inner surface of the extension.

23. The glove as in claim 13 further comprising a flap secured to the lower glove portion and removably securable to the upper glove portion.

* * * * *